US006085056A

United States Patent [19]

Okada

[11] Patent Number: 6,085,056

[45] Date of Patent: Jul. 4, 2000

[54] TONER CARTRIDGE WITH PARTITION WALL

[75] Inventor: Mitsuharu Okada, Osaka, Japan

[73] Assignee: Mita Industrial Co., Ltd., Japan

[21] Appl. No.: 09/004,099

[22] Filed: Jan. 7, 1998

[30] Foreign Application Priority Data

Jan. 17, 1997 [JP] Japan ..... 9-005930
Jan. 17, 1997 [JP] Japan ..... 9-005931

[51] Int. Cl.[7] ..... G03G 15/08

[52] U.S. Cl. ..... 399/262; 222/DIG. 1

[58] Field of Search ..... 399/30, 120, 262, 399/258, 254, 256, 263; 222/DIG. 1

[56] References Cited

U.S. PATENT DOCUMENTS

| | | | |
|---|---|---|---|
| 3,915,208 | 10/1975 | Anderson | 222/DIG. 1 X |
| 4,603,714 | 8/1986 | Marotta . | |
| 4,615,364 | 10/1986 | Kawata . | |
| 5,111,976 | 5/1992 | Ban . | |
| 5,345,297 | 9/1994 | Katakabe et al. | 399/263 |
| 5,346,102 | 9/1994 | Bhagwat | 222/DIG. 1 X |
| 5,438,396 | 8/1995 | Mawdesley | 399/262 |
| 5,508,794 | 4/1996 | Ikesue et al. | 399/120 |
| 5,565,973 | 10/1996 | Fujishiro et al. | 399/30 |
| 5,589,919 | 12/1996 | Ikuname et al. | 399/262 |
| 5,765,079 | 6/1998 | Yoshiki et al. | 399/258 |
| 5,774,772 | 6/1998 | Kai et al. | 399/260 |
| 5,848,338 | 12/1998 | Okada . | |

FOREIGN PATENT DOCUMENTS

| | | |
|---|---|---|
| 0098081 | 1/1984 | European Pat. Off. . |
| 0101303 | 2/1984 | European Pat. Off. . |
| 0404024 | 12/1990 | European Pat. Off. . |
| 0701181 | 3/1996 | European Pat. Off. . |
| 0710896 | 5/1996 | European Pat. Off. . |
| 62-121470 | 6/1987 | Japan . |
| 1-102487 | 4/1989 | Japan . |

OTHER PUBLICATIONS

*Patent Abstracts of Japan*, vol. 011, No. 337 (P–633), Nov. 5, 1987, Publ. No.: 62–121470–A, Canon Inc. Publ. Date: Jun. 2, 1987.

Patent Abstracts of Japan, vol. 008, No. 219 (P–306), Oct. 5, 1984, Publ. No.: 59–102262–A, Ricoh Co Ltd, Publ. Date Jun. 2, 1987.

*Primary Examiner*—Quana Grainger
*Attorney, Agent, or Firm*—Smith, Gambrell & Russell, LLP

[57] ABSTRACT

A toner cartridge is constructed from a container having a discharge opening in its bottom end surface, and a shutter mechanism mounted on the bottom end of the container. In a lower part of the container, at least one partition wall is disposed. The discharge opening of the container is present not entirely in the bottom end surface, but only partly in the surface. To the entire edge of the discharge opening, a wall extending upwardly at an inclination angle α of at least 45 degrees to the horizontal is connected.

5 Claims, 9 Drawing Sheets

TONER CARTRIDGE WITH PARTITION WALL

FIELD OF THE INVENTION

This invention relates to a toner cartridge for supplying a toner to a developing device for developing a latent electrostatic image into a toner image.

DESCRIPTION OF THE PRIOR ART

In an image forming machine such as a copier, a printer or a facsimile, a developing device which provides a toner to a latent electrostatic image to develop it into a toner image is disposed as is well known. In this developing device, the toner is consumed as development proceeds, which makes it necessary to supply a toner properly. This supply can be done advantageously by loading a toner cartridge into the developing device and discharging toner in the toner cartridge into the developing device.

As typical examples of the toner cartridge for supplying a toner to a developing device of an image forming machine, ones disclosed in Japanese Laid-Open Patent Publication Nos. 121470/87 and 102487/89 can be quoted. The toner cartridge is constructed from a container having a discharge opening at its bottom end, and a shutter mechanism mounted at the bottom end of this container. Usually, the container filled with a toner is blow molded from suitable synthetic resin, and its bottom end surface is opened as a whole (in other words, the discharge opening formed at the bottom end spreads over the entire bottom end surface). The shutter mechanism is constructed from a main member fixed at the bottom end of the container, and a shutter member mounted on this main member. The main member and the shutter member which constitute the shutter mechanism are usually injection molded or compression molded from suitable synthetic resin. In the main member of the shutter mechanism, two through-holes situated between the bottom end of the container and the shutter member are formed with a substantially 180° angular spacing. Each through-hole is in the form of a fan defined by radial edges extending with a substantially 90° angular spacing, and an arcuate edge extending between the radially outward ends of the radial edges. In the shutter member, two passage openings are formed with a substantially 180° angular spacing. These passage openings are in substantially the same fan shape as the through-holes described above. The shutter member is mounted on the main member so as to be rotatable relative to the main member about the central axis of the container between an opening position and a closing position.

When the shutter member is situated at the closing position, the two through-holes formed in the main member and the two passage openings formed in the shutter member are situated alternately to shut the container from the outside. To supply a toner to the developing device, the shutter mechanism is aligned with the required receiver portion of the developing device, and the toner cartridge is mounted on the developing device. Then, the shutter member of the shutter mechanism is rotated relative to the main member to situate it at the opening position. By this operation, the two passage openings of the shutter member are aligned with the two through-holes of the main member, so that the toner contained in the container is discharged from the discharge opening of the container through the through-holes and the passage openings. The discharged toner flows into the developing device through an acceptance opening present in the receiver portion of the developing device.

The following problems to be solved exist with the conventional toner cartridge described above.

First, in the toner cartridge of the type described above, the dimensions of the shutter mechanism, accordingly the dimensions of the bottom end of the container, are defined by the dimensions of the receiver portion in the developing device. To make the toner containing capacity of the toner cartridge large enough, therefore, it is usual practice to shape an upper part of the container like a cylinder of a relatively large diameter, and shape a lower part of the container like a truncated cone which has an inside diameter corresponding to that of the upper part and tapering downwardly toward the bottom end having the smallest diameter required. According to my experience, however, when the lower part of the container is in the form of a truncated cone, the toner causes a so-called bridge phenomenon in the truncated conical lower part. That is, the toner forms a dome-shaped lower surface, becomes blocked, and tends to flow less smoothly.

Second, in the main member of the shutter mechanism, there is a shielding wall in the cross sectional area excepting the through-holes. On the shielding wall, a considerable amount of toner tends to accumulate. The toner accumulating on the shielding wall does not flow into the developing device, but remains inside the toner cartridge to be separated from the developing device. Therefore, a considerable amount of toner is not used for development, but consumed wastefully.

To prevent the toner from accumulating on the shielding wall, the shielding wall can extend upwardly from the edges of the through-holes at a relatively large angle of inclination, for example, 45 degrees or more, relative to the horizontal. However, by making the entire shielding wall extend upwards with a relatively large angle of inclination, the height of the main member, that is, the dimension in the axial direction, necessarily increases. Usually, the increase in the height of the injection molded or compression molded main member leads to a marked increase in its manufacturing cost, accordingly, the manufacturing cost of the toner cartridge. Besides, in the usual manufacture of a toner cartridge, a toner is filled into the container through its discharge opening, and then the shutter mechanism is mounted on the container to complete the toner cartridge. Therefore, the toner containing capacity of the toner cartridge is determined by the capacity of the container itself, and the bulk of the shutter mechanism is not at all related to the toner containing capacity. Consequently, the increase in the height of the main member of the shutter mechanism dose not increase the toner containing capacity, but leads to the increase in the bulk of the toner cartridge.

SUMMARY OF THE INVENTION

A first object of the present invention is to provide an improved toner cartridge in which although the lower part of the container is shaped like a truncated cone whose inside diameter tapers off downwardly, the blocking of the toner in the lower part of the container is prevented.

A second object of the invention is to improve the toner cartridge so that without a marked increase in the manufacturing cost of the toner cartridge or without an excessive increase in the bulk of the toner cartridge compared with the toner containing capacity, a sufficient decrease is achieved in the amount of the toner remaining in the toner cartridge without flowing into the developing device.

Concerning the first object, I, the inventor, conducted extensive studies and experiments, and found the following facts: In the truncated conical lower part of the container, a pressure heading radially inwardly and upwardly acts on the toner substantially uniformly in the entire peripheral direction, thereby making the toner form a dome-shaped lower surface and become blocked. Based on this finding, I worked out such a constitution that at least one partition wall is disposed in the truncated conical lower part of the container, and the cross sectional shape of the lower part is made in such a shape as to have a partition wall extending in a practical circle, thereby to make the pressure imposed on the toner nonuniform at least locally in the peripheral direction. This constitution has been found to effectively prevent the toner from forming a dome-shaped lower surface and becoming blocked.

That is, the invention provides the toner cartridge attaining the first object, which is a toner cartridge comprising a container whose lower part is shaped like a truncated cone with an inside diameter tapering off downwardly and at the bottom end of which a discharge opening is formed; wherein at least one partition wall is disposed in the lower part of the container, and the cross sectional shape of the lower part is a shape with the partition wall extending in a circle.

In an embodiment of the invention, one partition wall extending diametrically continuously on the inner peripheral surface of the lower part is disposed. In another embodiment of the invention, a plurality of partition walls which project inwardly radially from the inner peripheral surface of the lower part are disposed with spacing in the peripheral direction. In still another embodiment of the invention, at a plurality of sites with spacing in the peripheral direction, the peripheral wall itself in the lower part is projected inwardly radially to construct a plurality of partition walls. In these embodiments, it is preferred that the inwardly projecting length of each of the plurality of partition walls be smaller than the inner radius of the lower part, and that there be none of the partition walls in the center of the lower part. Advantageously, the toner cartridge has a shutter mechanism mounted on the bottom end of the container, and the shutter mechanism is constructed from a main member fixed at the bottom end of the container and a shutter member mounted on the main member so as to be movable between a closing position and an opening position. It is also preferred that when the shutter member is situated at the closing position, a through-hole formed in the main member and a passage opening formed in the shutter member are displaced from each other to close the discharge opening of the container, and that when the shutter member is situated at the opening position, the through-hole and the passage opening are aligned with each other to open the discharge opening of the container via the through-hole and the passage opening.

To attain the second object, the invention adds the following improvement to the container that can be preferably blow molded, not injection or compression molded: The discharge opening of the container is present not in the entire bottom end surface of the container, but in only a part of it. To the entire edge of the discharge opening of the container, a wall extending upwards at an inclination angle $\alpha$ of at least 45 degrees to the horizontal is connected.

That is, the invention provides the toner cartridge attaining the second object, which is constructed from a container with a discharge opening at the bottom end thereof and a shutter mechanism mounted on the bottom end of the container, the shutter mechanism including a shutter member with a passage opening, the shutter member being movable relative to the container between an opening position where the discharge opening is caused to communicate with the outside through the passage opening and a closing position where the discharge opening is cut off from the outside, wherein the discharge opening of the container is present not in the entire bottom end surface of the container, but in only a part thereof, and a wall extending upwardly at an inclination angle a of at least 45 degrees to the horizontal is connected to the entire edge of the discharge opening of the container.

Preferably the container is blow molded from synthetic resin. In an embodiment of the invention, the bottom end surface of the container is circular, there are two of the discharge openings disposed with a substantially 180° angular spacing, and each of the discharge openings is in the form of a fan defined by two radial edges extending with a substantially 90° angular spacing, and an arcuate edge extending between the radially outward ends of the two radial edges. Two of the passage openings of the shutter member are formed with a substantially 180° angular spacing, and the two passage openings are in substantially the same form of a fan as the two discharge openings. The shutter member is mounted so as to be rotatable about the central axis of the container. At the opening position, the two passage openings are aligned with the two discharge openings, while at the closing position, the two passage openings and the two discharge openings are situated alternately. To the arcuate edge of each of the discharge openings, a curved wall is connected which is arcuate in cross sectional shape and which constitutes a part of a truncated cone. To one of the radial edges, an upright wall extending substantially vertically is connected, and the radially inward edge of the upright wall is inclined radially outwardly toward the above. The upper end of the upright wall is connected to the curved wall. To the other radial edge is connected a flat-curved wall which extends flatly in a radially outwardly inclined manner toward the above in the radial direction, and then smoothly continues to the curved wall to form a curved surface. In the other part than the discharge openings in the bottom end surface of the container, there are two fan-shaped lower surface walls extending substantially horizontally.

In another embodiment of the invention, the bottom end surface of the container is circular. The discharge opening, in a bottom view, is defined by two first straight edges which extend radially in a radially inward direction from the outer peripheral edge of the bottom end surface of the container with a substantially 180° angular spacing and which are shorter than the radius of the bottom end surface of the container, two second straight edges which extend from the radially inward end of the first straight edges substantially perpendicularly to the first straight edges and in opposite directions to each other as far as the outer peripheral edge of the bottom end surface of the container, an arcuate edge which extends from the radially outward end of one of the first straight edges to the radially outward end of the second straight edge extending from the radially inward end of the other first straight edge, and an arcuate edge which extends from the radially outward end of the other first straight edge to the radially outward end of the second straight edge extending from the radially inward end of the one of the first straight edges. The shutter mechanism includes a main member fixed to the bottom end of the container. The shutter member is mounted on the main member so as to be rotatable about the central axis of the container. In the main member, two through-holes positioned between the bottom end surface of the container and the shutter member are formed with a substantially 180° angular spacing. Two of the passage openings of the shutter member are disposed with a substantially 180° angular spacing. The two through-holes and the two passage openings are each in substantially the same shape of a fan defined by two radial edges extending with a substantially 90° angular spacing, and arcuate edge extending between the radially outward ends of the two radial edges. When the shutter member is in the opening position, the two through-holes and the two passage openings are aligned with each other. When the shutter member is in the closing position, the two through-holes and the two passage openings are situated alternately. In the main member of the shutter mechanism, a shielding wall extending from the edges of the two through-holes is formed. The part of the shielding wall, which lies in the area where the discharge openings of the container are present, extends upwardly away from the through-holes at an inclination angle β if at least 45° to the horizontal. To each of the arcuate edges of the discharge openings, a curved wall is connected which is arcuate in cross sectional shape and which is a part of a truncated cone. To each of the first straight edges, an upright wall extending substantially vertically is connected. The radially inward edge of the upright wall is inclined radially outwardly toward the above. The upper end of the upright wall is connected to the curved wall. To each of the second straight edges is connected a flat-curved wall which extends flatly in a radially outwardly inclined manner toward the above in the radial direction, and then smoothly continues to the curved wall to form a curved surface. If necessary, an upright linking wall which links the upright walls connected to the first straight edges is disposed. In the other part than the discharge openings in the bottom end surface of the container, there are two inclined walls extending downwardly from the second straight edges toward the outer peripheral edge. The inclined walls each form an inclination angle γ of from 10 to 30 degrees to the horizontal.

DETAILED DESCRIPTION OF THE PREFERRED EMBODIMENTS

The present invention will now be described in detail with reference to the accompanying drawings showing preferred embodiments of a toner cartridge constructed in accordance with the present invention.

Figure 1:
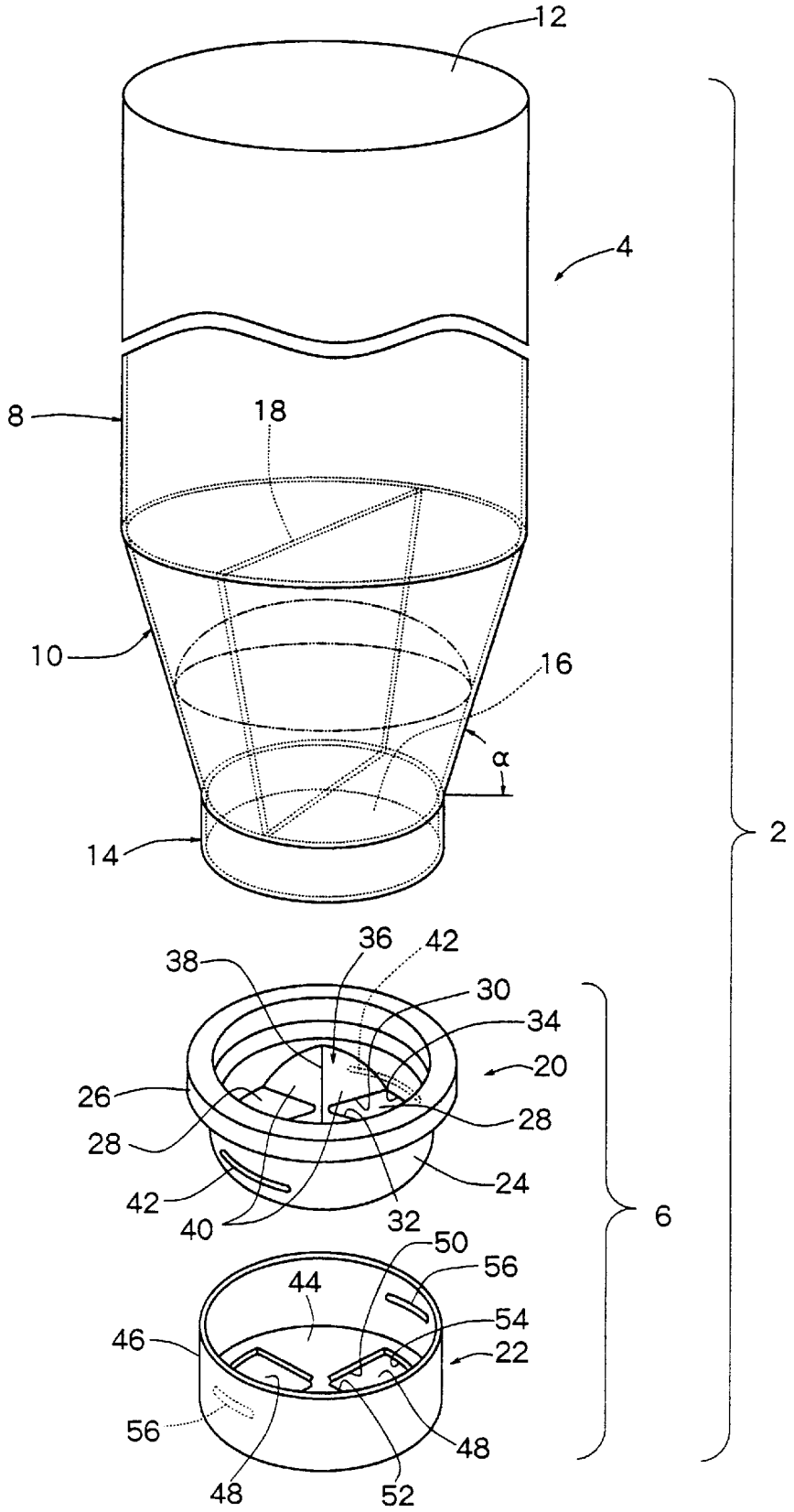
FIG. 1 is an exploded perspective view of a preferred embodiment of a toner cartridge constructed in accordance with one aspect of the present invention.

With reference to FIG. 1, a toner cartridge, shown entirely by the numeral 2, constructed in accordance with an aspect of the present invention, is composed of a container 4 and a shutter mechanism 6.

Preferably, the entire container 4 is blow molded from suitable synthetic resin. The container 4 has a cylindrical main part 8 and a truncated-conical lower part 10. The upper end surface of the main part 8, that is, the upper end surface of the container 4, is closed with a top wall 12. A peripheral wall of the lower part 10 which is truncated-conical is inclined at an inclination angle α to the horizontal. Preferably, the inclination angle α is 50 degrees or more, especially, not less than the angle of repose (usually about 60 degrees) of the toner contained in the container 4. To the lower part 10, a connecting projecting ring 14 extending downward is attached. The connecting projecting ring 14 may be in the shape of a cylinder having substantially the same inside diameter as that of the truncated conical lower part 10. The bottom end of the container 4 is entirely open, and defines a discharge opening 16 whose cross sectional shape may be circular.

Figure 2:
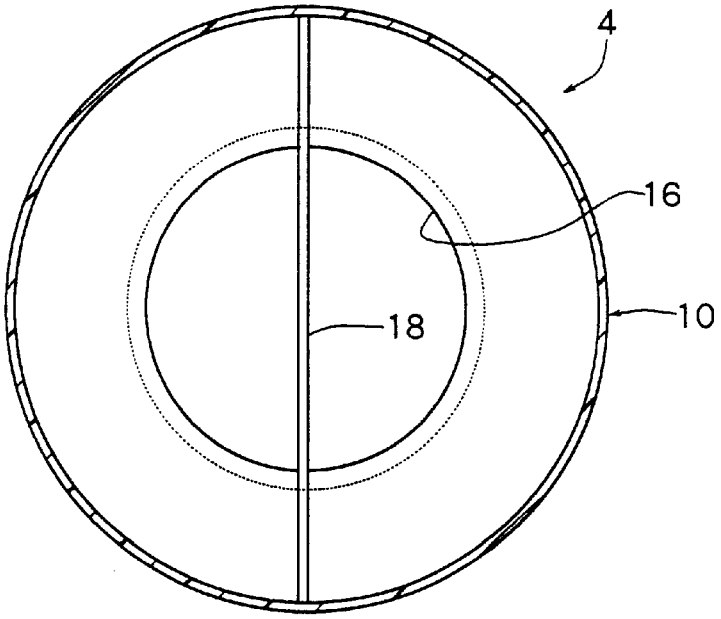
FIG. 2 is a cross sectional view of a container in the toner cartridge shown in FIG. 1.

With reference to FIG. 2 along with FIG. 1, on the lower part 10 of the container 4, an upright partition wall 18 extending continuously diametrically on the inner peripheral surface is disposed. Both side edges of this partition wall 18 are connected to the inner peripheral surface of the truncated conical lower part 10. Thus, both side edges of the partition wall 18 extend in a radially inclined manner toward the below with the above-mentioned inclination angle α to the horizontal.

With reference to FIG. 1 again, the shutter mechanism 6 is constructed from a main member 20 and a shutter member 22. The main member 20 and the shutter member 22 can be preferably formed from suitable synthetic resin by injection molding or compression molding. The main member 20 has a cylindrical main portion 24 and a linking projecting ring 26 connected to the upper end of this main portion 24. The inner diameter of the main portion 24 is substantially the same as the inner diameter of the projecting ring 14 in the container 4, while the inner diameter of the projecting ring 26 is substantially the same as the outer diameter of the projecting ring 14 on the container 4 (thus, the inner radius of the projecting ring 26 is larger than the inner radius of the main portion 24 by the length corresponding to the wall thickness of the projecting ring 14 of the container 4). In the main portion 24, two through-holes 28 are formed with a substantially 180° angular spacing. Each through-hole 28 is defined by two radial edges 30 and 32 extending with a substantially 90° angular spacing, and an arcuate edge 34 extending between the radially outward ends of the radial edges 30 and 32. In other space than the through-holes 28 in the circular area defined in the cylindrical main portion 24, there is a shielding wall 36. The upper surface of this shielding wall 36 is defined by an inclined surface 40 which is inclined downward from a diametrically extending ridge-line 38 toward the respective radial edges 30 and 32 of the through-holes 28. On the outer peripheral surface of the main portion 24, two guide grooves 42 are formed with a 180° angular spacing. Each guide groove extends in the circumferential direction substantially horizontally.

The shutter member 22 of the shutter mechanism 6 has a bottom surface wall 44 extending substantially horizontally and a linking projecting ring 46 projecting upward from the peripheral edge of this bottom surface wall 44. In the bottom surface wall 44, two passage openings 48 are formed with a substantially 180° angular spacing. Each passage opening 48 is substantially the same as each of the two through-holes 28 formed in the main member 20. Each passage opening 48 is defined by two radial edges 50 and 52 extending substantially with a 90° angular spacing and an arcuate edge 54 extending between the radially outward ends of the radial edges 50 and 52. The inner diameter of the projecting ring 46 of the shutter member 22 is set to be substantially the same as the outer diameter of the main portion 24 of the main member 20. On the inner peripheral surface of the projecting ring 46, two engaging ridges 56 are formed with a 180° angular spacing. Each of the two engaging ridges 56 extend in the circumferential direction substantially horizontally.

The projecting ring 46 of the shutter member 22 is situated outside of the main part 24 of the main member 20, and the engaging ridges 56 formed on the inner peripheral surface of the projecting ring 46 are engaged with the guide grooves 42 formed on the outer peripheral surface of the main portion 24 of the main member 20 (at the time of this engagement, the projecting ring 46 and/or the main portion 24 are or is deformed elastically). By this measure, the shutter member 22 is mounted on the main member 20 so as to be rotatable about the central axis of the main member 20 and the shutter member 22 (thus, the central axis of the container 4 as will become clear from a description given later on). When the shutter member 22 is turned clockwise relative to the main member 20 as seen from above to contact one end of the engaging ridge 56 with one end of the guide groove 42, the shutter member 22 is inhibited from further turning clockwise relatively, and the shutter member 22 is situated at the closing position. By so doing, the passage openings 48 of the shutter member 22 and the through-holes 28 of the main member 20 are situated alternately. This makes the through-holes 28 of the main member 20 closed with the bottom surface wall 44 of the shutter member 22, and makes the passage openings 48 of the shutter member 22 closed with the shielding wall 36 of the main member 20. When the shutter member 22 is turned 90° counterclockwise relative to the main member 20, the other end of the engaging ridge 56 is contacted with the other end of the guide groove 42 to inhibit the shutter member 22 from further turning counterclockwise relatively. Thus, the shutter member 22 is situated at the opening position. As a result, the passage openings 48 of the shutter member 22 and the through-holes 28 of the main member 20 are aligned with each other.

In the assembly of the toner cartridge 2 described above, at first the container 4 is inverted (that is, a condition in which the projecting ring 14 attached to its bottom end surface projects upward) to fill a required amount of toner into the container 4 through its discharge opening 16. Then, the shutter mechanism 6, whose shutter member 22 has been mounted on the main member 20 as required and has been situated at the closing position, is mounted on the projecting ring 14 of the container 4 to close the discharge opening 16 of the container 4. The mounting of the shutter mechanism 6 on the container 4 is achieved by force fitting the projecting ring 14 of the container 4 into the projecting ring 26 formed in the main member 20 of the shutter mechanism 6 to fix the main member 22 to the projecting ring 14 of the container 4.

For the supply of toner by the toner cartridge 2 to a developing device (not shown), the toner cartridge 2 is placed in a properly erected state (that is, a condition in which the shutter mechanism 6 is situated below the container 4 as shown in FIG. 1), the shutter mechanism 6 is aligned with a receiver portion of the developing device, and the toner cartridge 2 is mounted on the developing device. By mounting the toner cartridge 2 on the receiver portion of the developing device as required, a pair of projecting pins (not shown) formed on the lower surface of the shutter member 22 are inserted into a pair of holes formed in the receiver portion, thereby preventing the shutter member 22 from turning relative to the developing device. Then, the container 4 and the main member 20 of the shutter mechanism 6 are turned 90° clockwise relative to the developing device, whereby the shutter member 22 is turned 90° counterclockwise relative to the main member 20 in the shutter mechanism 6 to situate it at the opening position. As a result, the passage openings 48 of the shutter member 22 are aligned with the through-holes 28 of the main member 20 in the shutter mechanism 6. Thus, the toner contained in the container 4 is discharged through the discharging opening 16, the through-holes 28 and the passage openings 48 and flows from the receiver portion into the developing device.

If the partition wall 18 dose not exist in the truncated-conical lower part 10 of the container 4, the toner causes a so-called bridge phenomenon in the lower part 10. As schematically illustrated by a two-dot chain line in FIG. 1, the toner tends to form a dome-shaped lower surface and become blocked. By disposing the partition wall 18, however, such blockage of the toner is effectively prevented and the toner flows down smoothly in the container 4 to be discharged through the discharge opening 16.

Figure 3:
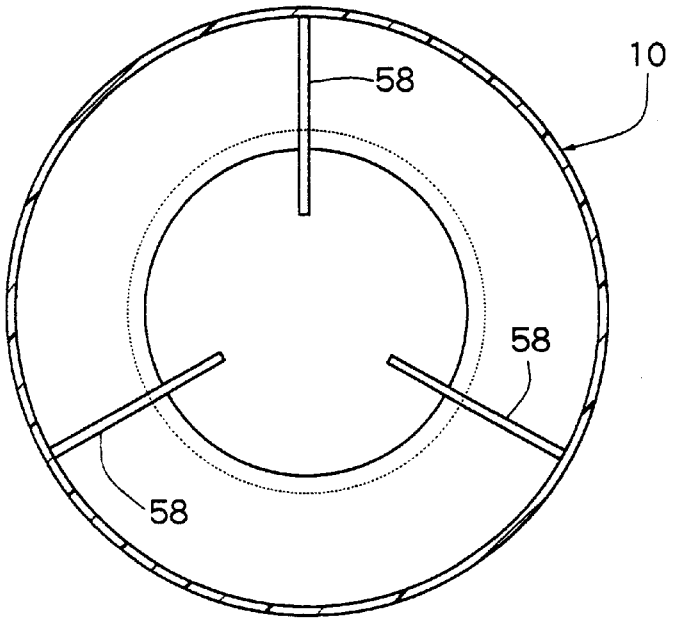
FIG. 3 is a cross sectional view similar to FIG. 2 showing a modified example of a partition wall.

FIG. 3 shows a modified example of the partition wall disposed in the lower part 10 of the container 4. In the modified example shown in FIG. 3, in the truncated-conical lower part 10 of the container 4, three upright partition walls 58 are disposed with equal spacing in the circumferential direction. Each partition wall 58 projects in a radial form from the inner peripheral surface of the lower part 10 inwardly in the radial direction. The radially projecting length of the partition wall 58 is shorter than the inner radius of the lower part 10, so that the partition wall 58 is not present in the center of the lower part 10. It is preferred that the radially inward edge of each partition wall 58 extends substantially vertically.

Figure 4:
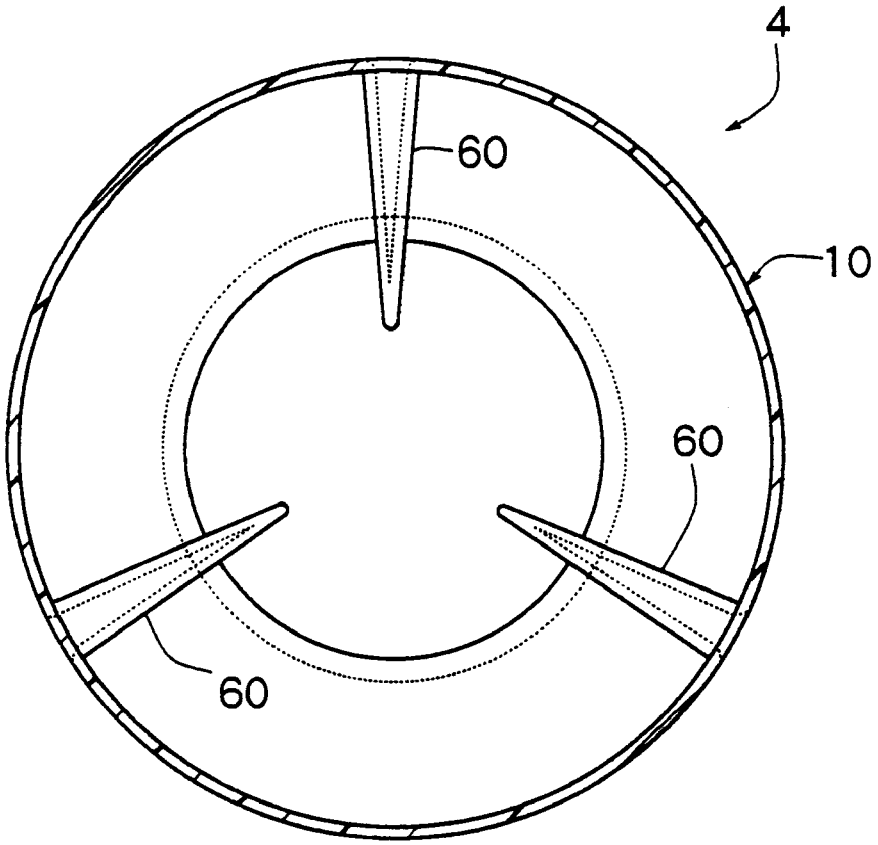
FIG. 4 is a cross sectional view similar to FIG. 2 showing another modified example of a partition wall.

FIG. 4 shows another modified example of the partition wall disposed in the lower part 10 of the container 4. In the modified example shown in FIG. 4, at three sites situated with equal spacing in the circumferential direction, the peripheral wall of the lower part 10 is projected itself in a radial manner in the radially inward direction to form three upright partition walls 60. The radially projecting length of the partition wall 60, like the partition wall 58 illustrated in FIG. 3, is shorter than the inner radius of the lower part 10, and thus there is no partition wall 60 in the center of the lower part 10. It is preferred that the radially inward edge of each partition wall 60 extends substantially vertically.

Also in the modified examples illustrated in FIGS. 3 and 4, as in the toner cartridge 2 illustrated in FIGS. 1 and 2, the presence of the partition walls 58 and 60 effectively prevents the toner from causing the bridge phenomenon and becoming blocked in the truncated-conical lower part 10 of the container 4.

In the illustrated embodiments, the partition walls 18, 58 and 60 extend substantially vertically in a radial or diametrical manner with respect to the peripheral wall of the lower part 10. If desired, however, it is possible to dispose a partition wall which extends in a chordal form inclined with respect to the peripheral wall of the lower part 10. Moreover, the partition walls 18, 58 and 60 in the illustrated embodiments are upright partition walls which extend substantially vertically in the up-and-down direction. If desired, however, a partition wall inclined in an arbitrary direction may be disposed.

Figure 5:
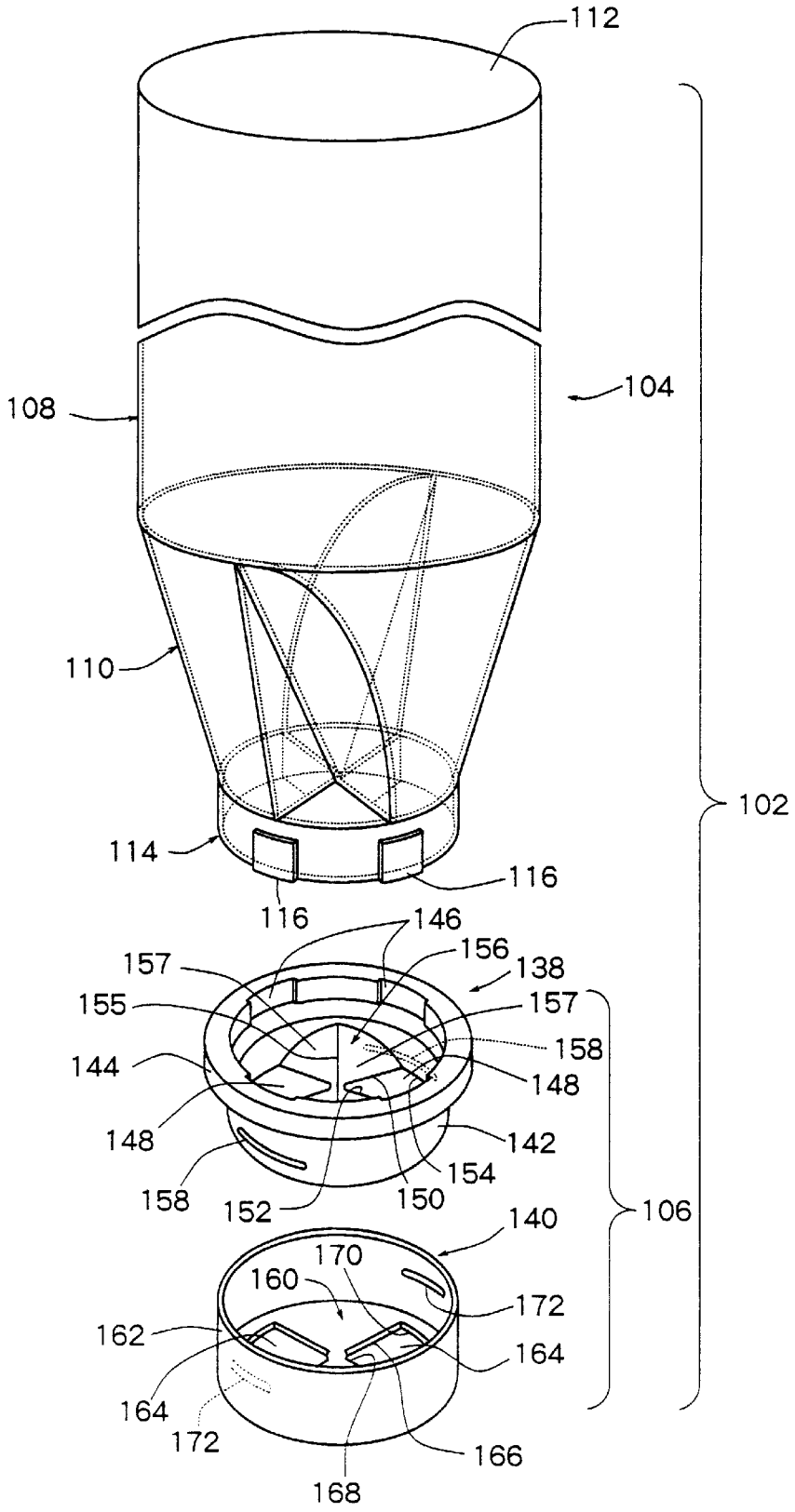
FIG. 5 is an exploded perspective view of a preferred embodiment of a toner cartridge constructed in accordance with another aspect of the present invention.
Figure 6:
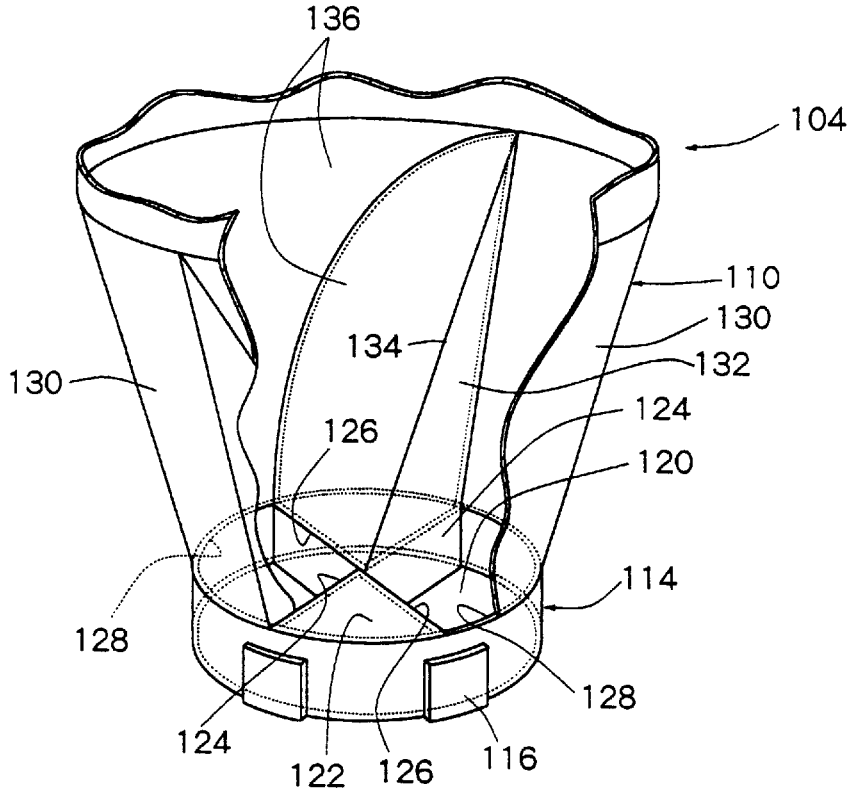
FIG. 6 is a partial perspective view, partly broken away, of a lower part of a container in the toner cartridge shown in FIG. 5.
Figure 7:
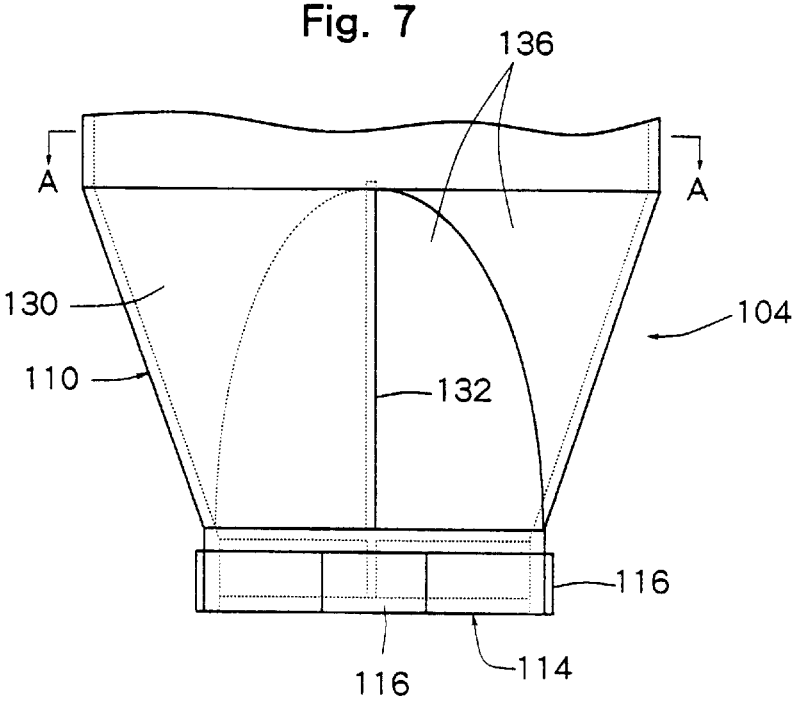
FIG. 7 is a partial front view of the lower part of the container in the toner cartridge shown in FIG. 5.
Figure 8:
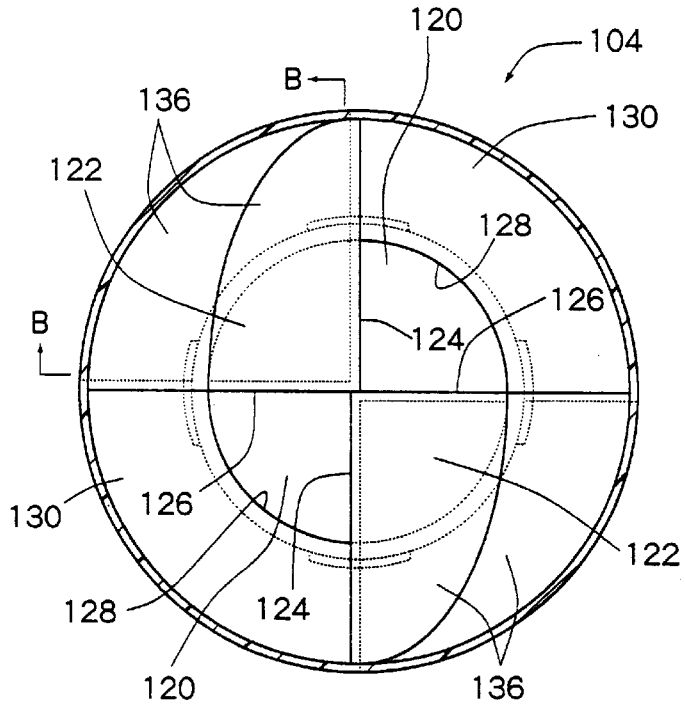
FIG. 8 is a cross sectional view taken along line A—A of FIG. 7.
Figure 9:
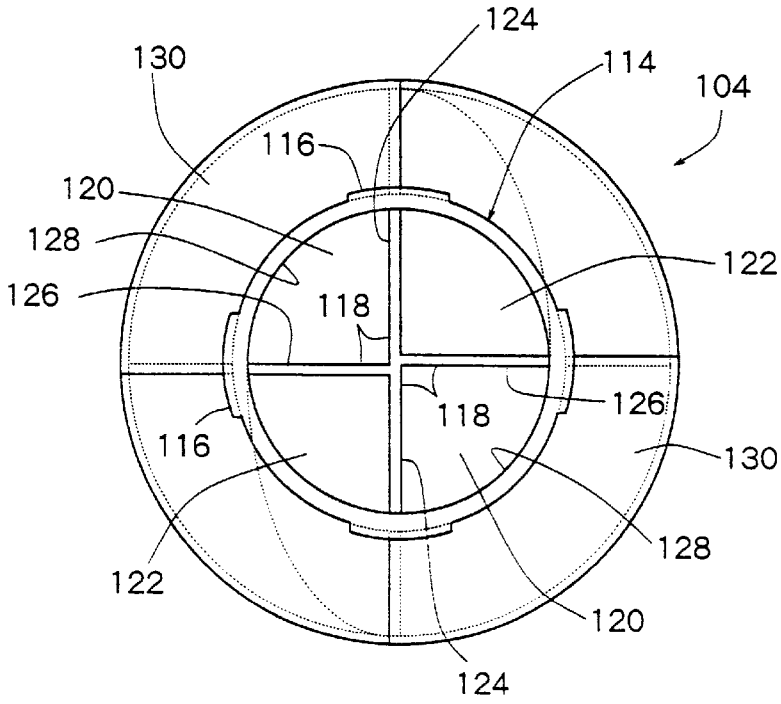
FIG. 9 is a bottom view of the container in the toner cartridge shown in FIG. 5.
Figure 10:
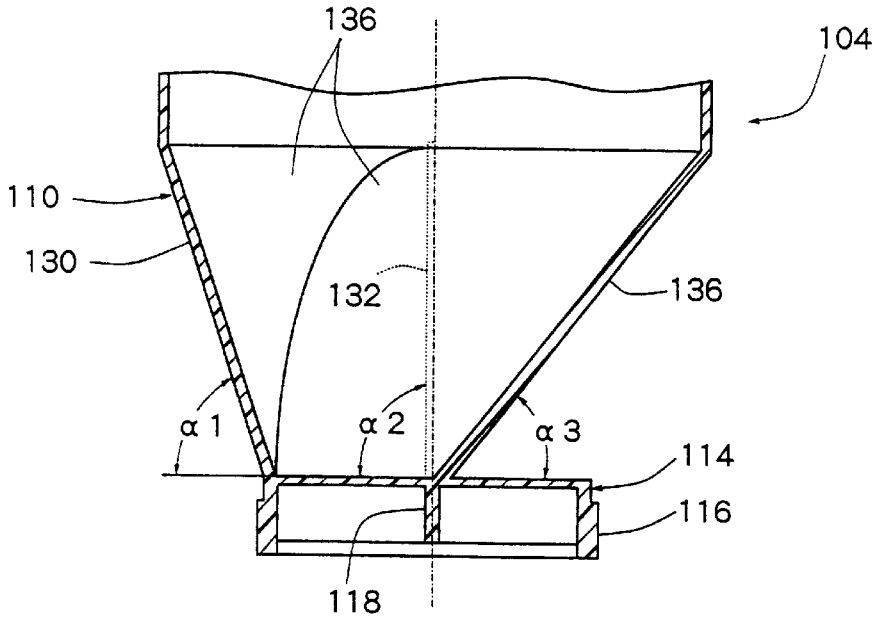
FIG. 10 is a vertical sectional view taken along line B—B of FIG. 8.
Figure 11:
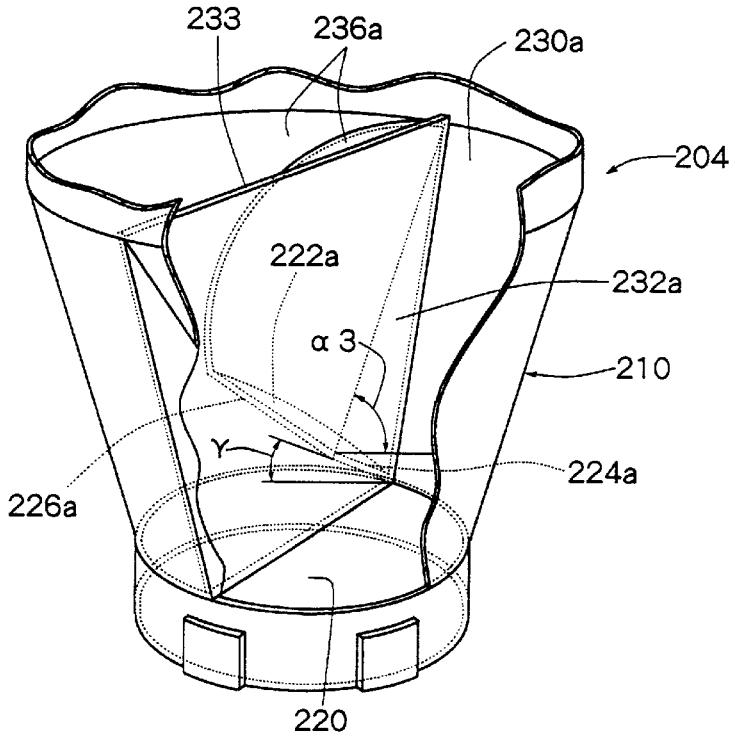
FIG. 11 is a partial perspective view, partly broken away, of a modified example of the lower part of the container in the toner cartridge constructed in accordance with the above another aspect of the present invention.

In FIG. 5, a preferred embodiment of a toner cartridge constructed according to another aspect of this invention is shown. A toner cartridge entirely indicated by the numeral 102 is also constructed from a container 104 and a shutter mechanism 106.

Advantageously, the container 104 as a whole is integrally blow molded from suitable synthetic resin. The container 104 has a cylindrical main part 108 and a nearly truncated-conical lower part 110. The upper end surface of the main part 108, that is, the upper end surface of the container 104 is closed with a top wall 112. To the lower part 110, a linking projecting ring 114 extending downward is attached. The linking projecting ring 114 is shaped like a cylinder with a small diameter. On its outer peripheral surface, four protrusions 116 are formed with 90° angular spacing. Each protrusion 116 is in the form of a band extending in the circumferential direction.

With reference to FIGS. 6 to 10 along with FIG. 5, the bottom end surface of the container 104 (that is, the upper surface of the linking projecting ring 114) is circular. On the linking projecting ring 114, four ribs 118 are formed which extend radially with 90° angular spacing. As can be seen clearly by reference to FIGS. 8 and 9, the four ribs 118 divide the circular lower end surface into four fan-shaped areas. Two of the four fan-shaped areas are open to define fan-shaped discharge openings 120. The remaining two fan-shaped areas are closed with fan-shaped lower surface walls 122 extending substantially horizontally. The discharge openings 120 and the lower surface walls 122 are situated alternately. Therefore, the two discharge openings 120 formed in the bottom end of the container 104 are disposed with a substantially 180° angular spacing.

Each discharge opening 120 disposed in the bottom end of the container 104 is fan-shaped as described above. It is defined by two radial edges 124 and 126 extending with a substantially 90° angular spacing, and an arcuate edge 128 extending between the radially outward ends of the radial edges 124 and 126. It is important that to the radial edges 124 and 126 and the arcuate edge 128 of each discharge opening 120, a wall be connected which extends upward at an inclination angle $\alpha$ of at least 45° to the horizontal. Preferably, the inclination angle is 50° or more, especially not less than the angle of repose (usually about 60° ) of the toner filled into the container 104. As will be clearly understood by reference to FIGS. 6 and 10, to the arcuated edge 128 of each discharge opening 120 is connected a curved wall 130 whose cross sectional shape is arcuate and which is a part of a truncated cone having a radius increasing gradually toward the above. This curved wall 130 extends upwards radially outwardly at an inclination angle $\alpha 1$ of about 70 degrees to the horizontal. To one of the two radial edges 124 and 126 is connected an upright wall 132 which extends upward substantially vertically, that is, at an inclination angle of substantially 90 degrees to the horizontal. The radially inward edge 134 of this upright wall 132 is inclined upward in the radially outward direction, and smoothly connects with the upper end of the curved wall 130. To the other edge 126 of the two radial edges 124 and 126 is connected a flat-curved wall which extends flatly in a radially outwardly inclined manner toward the above in the radial direction, and then smoothly continues to the curved wall 130. An inclination angle $\alpha 3$ which the flat wall part of the flat-curved wall 136 makes with the horizontal is about 50 degrees. As understood by reference to FIGS. 6 and 10 together with FIG. 5, the nearly truncated conical lower part 110 in the container 104 is defined by the curved wall 130, upright wall 132 and flat-curved wall 136.

With reference to FIG. 5 again, the shutter mechanism 106 is constructed from a main member 138 and a shutter member 140. The main member 138 and the shutter member 140 can be preferably formed from suitable synthetic resin by injection molding or compression molding. The main member 138 has a cylindrical main part 142 and a linking projecting ring 144 connected to the upper end of this main part 142. The inner diameter of the main part 142 is substantially the same as the inner diameter of the projecting ring 114 on the container 104, while the inner diameter of the projecting ring 144 is substantially the same as the outer diameter of the projecting ring 114 on the container 104 (thus, the inner radius of the projecting ring 144 is larger than the inner radius of the main part 142 by the length corresponding to the wall thickness of the projecting ring 114 of the container 104). On the inner peripheral surface of the projecting ring 144, four depressions 146 are formed with 90° angular spacing. Each depression 146 is belt-shaped in correspondence with each protrusion 116 formed on the outer peripheral surface of the projecting ring 114 on the container 104. In the main part 142, there are two through-holes 148 formed with a substantially 180° angular spacing. Each through-hole 148 is substantially the same as each of the discharge openings 120 formed in the bottom surface of the container 104 (or has a similar shape to the shape of each of the two discharge openings 120, but has a slightly smaller size). Each through-hole 148 is defined by two radial edges 150 and 152 extending with a substantially 90° angular spacing, and an arcuate edge 154 extending between the radially outward ends of the radial edges 150 and 152. In other space than the through-holes 148 in the circular area defined in the cylindrical main part 142, there is a shielding wall 156. The upper surface of this shielding wall 156 is defined by an inclined surface 157 which is inclined downward from a diametrically extending ridgeline 155 toward the respective radial edges 150 and 152 of the through-holes 148. On the outer peripheral surface of the main part 142, two guide grooves 158 are formed with a 180° angular spacing. Each guide groove 158 extends in the circumferential direction substantially horizontally.

The shutter member 140 of the shutter mechanism 106 has a bottom surface wall 160 extending substantially horizontally, and a linking projecting ring 162 projecting upward from the peripheral edge of this bottom surface wall 160. In the bottom surface wall 160, two passage openings 164 are formed with substantially 180° angular spacing. Each passage opening 164 is also substantially the same as each of the two discharge openings 120 formed in the bottom end surface of the container 104 (or has a similar shape to the shape of each of the two discharge openings 120, but has a little smaller size). Each passage opening 164 is defined by two radial edges 166 and 168 extending with substantially 90° angular spacing and an arcuate edge 170 extending between the radially outward ends of the radial edges 166 and 168. The inner diameter of the projecting ring 162 of the shutter member 140 is set to be substantially the same as the outer diameter of the main part 142 of the main member 138. On the inner peripheral surface of the projecting ring 162, two engaging ridges 172 are formed with 180° angular spacing. Each of the two engaging ridges 172 extends in the circumferential direction substantially horizontally.

The projecting ring 162 of the shutter member 140 is situated outside of the main part 142 of the main member 138, and the engaging ridges 172 formed on the inner peripheral surface of the projecting ring 162 are engaged with the guide grooves 158 formed in the outer peripheral surface of the main part 142 of the main member 138 (at this engagement, the projecting ring 162 and/or the main part 142 are or is deformed elastically). By this measure, the shutter member 140 is mounted on the main member 138 rotatably about the central axis of the main member 138 and the shutter member 140 (thus, the central axis of the container 104 as will become clear from a description given later on). The shutter member 140 is turned clockwise as seen from above relative to the main member 138 to contact one end of the engaging ridge 172 to one end of the guide groove 158. Thus, the shutter member 140 is inhibited from further turning clockwise relatively, and the shutter member 140 is situated at the closing position. By so doing, the passage openings 164 of the shutter member 140 and the through-holes 148 of the main member 138 are situated alternately. This makes the through-holes 148 of the main member 138 closed with the bottom surface wall 160 of the shutter member 140, and makes the passage openings 164 of the shutter member 140 closed with the shielding wall 156 of the main member 138. When the shutter member 140 is turned 90° counterclockwise relative to the main member 138, the other end of the engaging ridge 172 is contacted with the other end of the guide groove 158 to inhibit the shutter member 140 from further turning counterclockwise relatively, and the shutter member 140 is situated at the opening position. Thus, the passage openings 164 of the shutter member 140 and the through-holes 148 of the main member 138 are aligned with each other.

In the assembly of the toner cartridge 102 described above, at first the container 104 is put in an inverted state (that is, a condition in which the projecting ring 114 attached to its bottom end surface projects upward) to fill a required amount of toner into the container 104 through its discharge opening 120. Then, the shutter mechanism 106, whose shutter member 140 has been mounted on the main member 138 as required and has been situated at the closing position, is mounted on the projecting ring 114 of the container 104 to close the discharge opening 120 of the container 104. The mounting of the shutter mechanism 106 on the container 104 is achieved by force fitting the projecting ring 114 of the container 104 into the projecting ring 144 formed in the main member 138 of the shutter mechanism 106 to fix the main member 138 to the projecting ring 114 of the container 104. At this time, the four protrusion 116 formed on the outer peripheral surface of the projecting ring 114 are aligned with the four depressions 146 formed on the inner peripheral surface of the projecting ring 144. By this measure, the two discharge openings 120 of the container 104 are aligned with the two through-holes 148 formed in the main member 138 of the shutter mechanism 106.

For the supply of the toner by the toner cartridge 102 to a developing device (not shown), the toner cartridge is put in a properly erected state (that is, a condition in which the shutter mechanism 106 is situated below the container 104 as shown in FIG. 5), the shutter mechanism 106 is aligned with a receiver portion of the developing device, and the toner cartridge 102 is mounted on the developing device. By mounting the toner cartridge 102 on the receiver portion of the developing device as required, a pair of projecting pins (not shown) formed on the lower surface of the shutter member 140 are inserted into a pair of holes formed in the receiver portion, thus preventing the shutter member 140 from turning relative to the developing device. Then, the container 104 and the main member 138 of the shutter mechanism 106 are turned 90° clockwise relative to the developing device, whereby the shutter member 140 is turned 90° counterclockwise relative to the main member 138 in the shutter mechanism 106 to situate it at the opening position. As a result, the passage openings 164 of the shutter member 140 in the shutter mechanism 106 are aligned with the through-hole 148 of the main member 138 in the shutter mechanism 106 which has been aligned with the discharge opening 120 in the container 104. Thus, the toner in the container 104 is discharged sequentially through the discharge opening 120, through-holes 148 and passage openings 164 in alignment, and the toner flows from the receiver portion into the developing device. When flowing in the lower part 110 of the nearly truncated conical shape in the container 104, the toner is guided by the curved wall 130, upright wall 132 and flat-curved wall 136 to the discharge opening 120, then discharged well enough through the discharge opening 120, through-holes 148 and passage openings 164. Substantially, it does not happen that the toner drops on the shielding wall 156 existing on the main member 138 of the shutter mechanism. Since the curved wall 130, upright wall 132 and flat-curved wall 136 of the container 104 extend upward at inclination angles $\alpha 1$, $\alpha 2$ and $\alpha 3$ (at least 45 degrees) to the horizontal, the toner flows sufficiently smoothly on the curved wall 130, upright wall 132 and flat-curved wall 136. Thus, the toner is substantially unlikely to remain on the curved wall 130, upright wall 132 and flat-curved wall 136.

The following facts should be borne in mind in respect of the above-described toner cartridge 102 constructed according to the present invention. The container 104 can be preferably formed by blow molding, so that the formation of the curved wall 130, upright wall 132 and flat-curved wall 136 described above in the lower part 110 does not lead to a marked increase in the production cost. Besides, if the axial length of the lower part of the container 104 is made relatively large to set sufficiently large inclination angles $\alpha 1$, $\alpha 2$ and $\alpha 3$ of the curved wall 130, upright wall 132 and flat-curved wall 136, the toner containing capacity of the container 104 necessarily increase. Thus, the bulk of the toner cartridge 102 relative to the toner containing capacity is not excessively increased. In the embodiment illustrated, the lower part of the container 104 in which the curved wall 130, upright wall 132 and flat-curved wall 136 are disposed is nearly truncated-conical. If desired, however, the lower part of the container 104 may be given other suitable shape such as a nearly cylindrical shape (in this case, the curved wall 130 constitutes a part of the cylinder), a nearly truncated pyramidal shape, or a nearly square prismatic shape.

In FIGS. 11 to 15, a modified example of the nearly truncated-conical lower part of the container is illustrated. In the lower part 210 of the container 204 shown in FIGS. 11 to 15, a single discharge opening 220 is formed in the bottom end surface (strictly, the opening 220 is separated into two parts by an upright connecting wall 233 to be described below). This discharge opening 220 is, in a bottom view, that is, in FIG. 14, defined by two first straight edges 224*a* and 224*b* extending in a radial form from the outer peripheral edge of the bottom end surface in the radially inward direction with substantially 180° angular spacing, two second straight edges 226*a* and 226*b* extending from the radially inward ends of the first straight edges 224*a* and 224*b* substantially perpendicularly to the first straight edges 224*a* and 224*b* and in opposite directions to each other (that is, one edge to the right and the other to the left in FIG. 14), an arcuate edge 228*a* which extends from the radially outward end of one of the first straight edges 224*a* to the radially outward end of the second straight edge 226*b* extending from the radially inward end of the other first straight edge 224*b*, and an arcuate edge 228*b* which extends from the radially outward end of the other first straight edge 224*b* to the radially outward end of the second straight edge 226*a* extending from the radially inward end of the one first straight edge 224*a*. It is preferred that the length of each of the two first straight edges 224*a* and 224*b* be about a half of the radius of the circular bottom end surface.

Also in the modified example shown in FIGS. 11 to 15, it is important that to the entire edge of the discharge opening 220 is connected a wall which extends upward at an inclination angle α of at least 45 degrees, preferably 50 degrees or more, especially not less than the angle of repose of the toner filled in the container, to the horizontal. To the arcuate edges 228*a* and 228*b* are connected curved walls 230*a* and 230*b* whose cross sectional shapes are arcuate and which constitute a part of a truncated cone having a radius gradually increasing toward the above. Such curved walls 230*a* and 230*b* extend upward in the radially outward direction at an inclination angle α1 of nearly 70 degrees to the horizontal. To the first straight edges 224*a* and 224*b* are connected upright walls 232*a* and 232*b* which extend upward substantially vertically, that is, at an inclination angle α2 of substantially 90° to the horizontal. An upright connecting wall 233 which connects the upright walls 232*a* and 232*b* together is attached. Thus, the inside of the lower part 210 of the container 204 is divided into two parts by the upright connecting wall 233 extending diametrically. To the second straight edges 226*a* and 226*b*, are connected flat-curved walls 236*a* and 236*b* which extend flatly in a radially outwardly inclined manner in the radially upward direction, and then smoothly continue to the curved walls 230*a* and 230*b*. An inclination angle α3 which the flat wall parts of the flat-curved walls 236*a* and 236*b* make with the horizontal is about 50 degrees.

Figure 12:
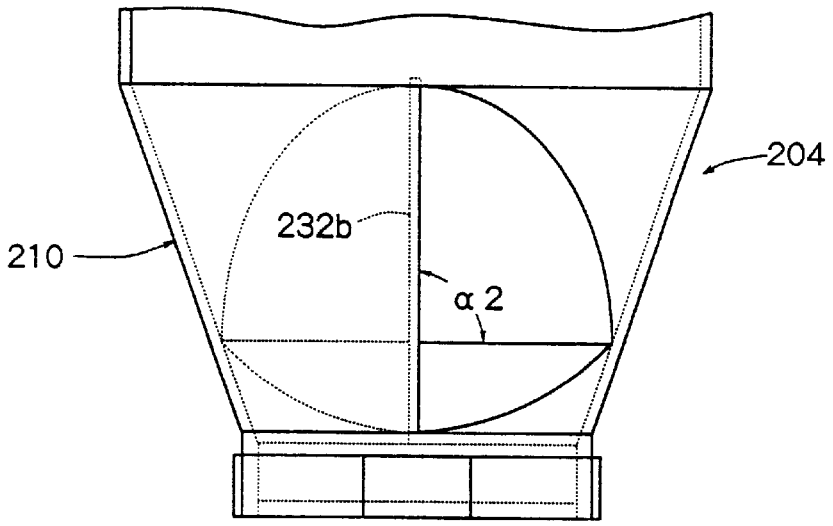
FIG. 12 is a partial front view of the lower part of the container shown in FIG. 11.
Figure 13:
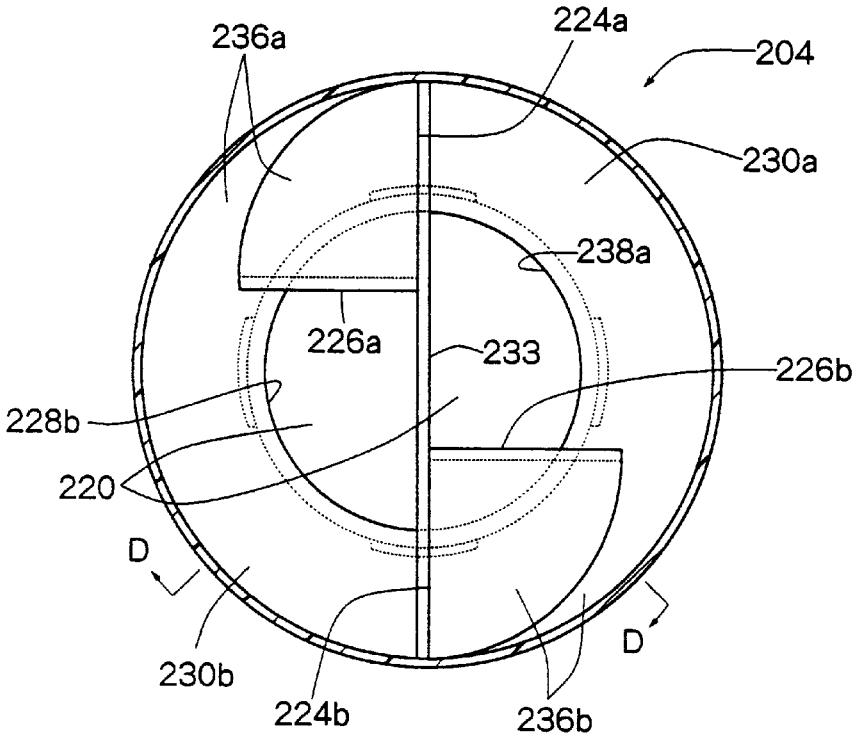
FIG. 13 is a cross sectional view taken along line C—C of FIG. 12.
Figure 14:
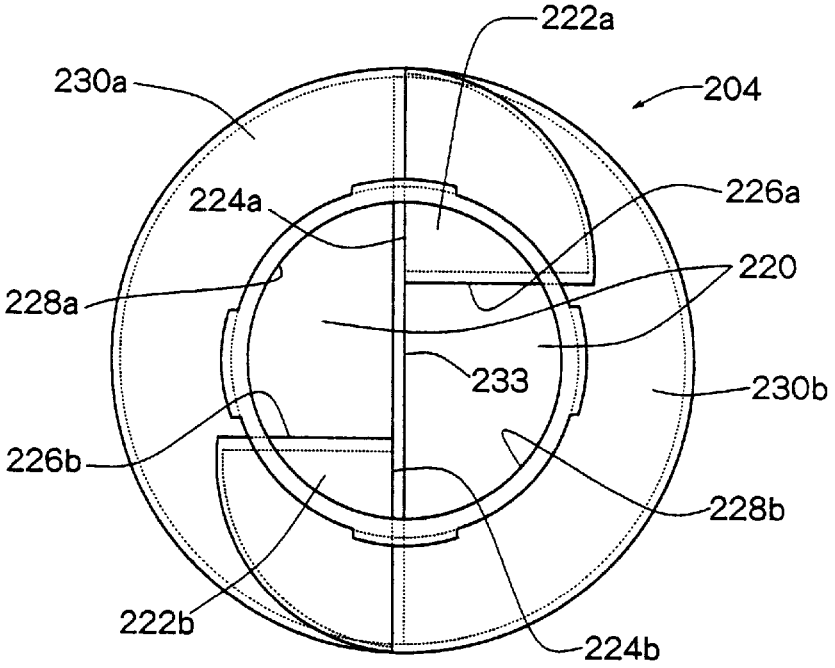
FIG. 14 is a bottom view of the lower part of the container shown in FIG. 11.
Figure 15:
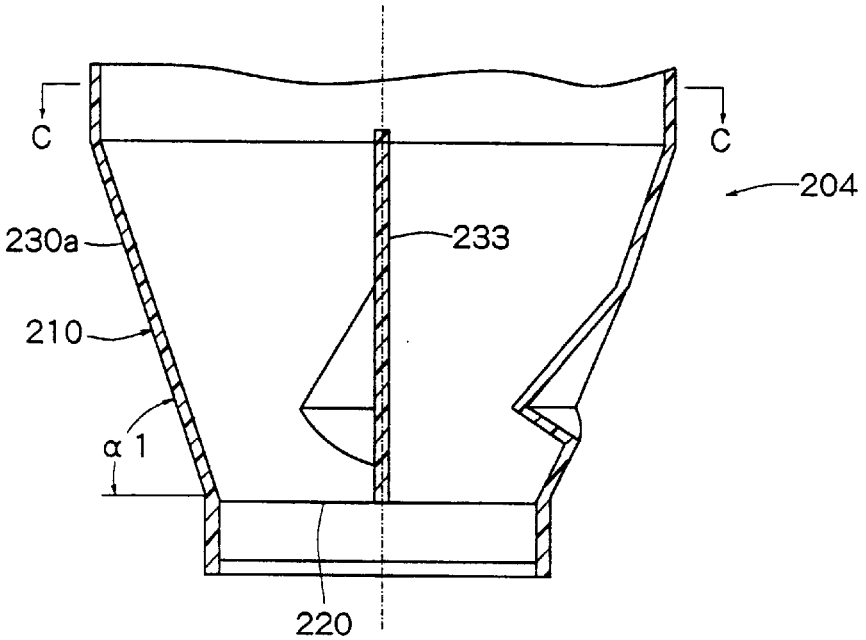
FIG. 15 is a vertical sectional view taken along line D—D of FIG. 13.

Besides, in the modified example shown in FIGS. 11 to 15, as understood by reference to FIGS. 12 and FIG. 15, in particular, inclined walls 222*a* and 222*b* which extend, not horizontally, but in a downwardly inclined manner from the second straight edges 226*a* and 226*b* of the discharge opening 220 toward the outer peripheral edge are present in other area than the discharge opening 220 in the bottom end surface of the container 204. An inclination angle γ which the inclined walls 222*a* and 222*b* make with the horizontal may be about 10 to 30 degrees.

In the modified example shown in FIGS. 11 to 15, the discharge opening 220 formed in the bottom end surface of the container 204 is single, and the central area of the bottom end surface is open. The walls existing in other area than the discharge opening 220 in the bottom end surface are not horizontal, but extend in a downwardly inclined manner from the first straight edges 224*a* and 224*b* of the discharge opening 220 toward the outer peripheral edge. In other words, these walls are the inclined surfaces 222*a* and 222*b* which extend in an upwardly inclined manner from the outer peripheral edge toward the second straight edges 226*a* and 226*b* of the discharge opening 220. Thus, the supply of toner into the container 204 through the discharge opening 220 can be attained sufficiently easily. Besides, the inside of the truncated-conical lower part 210 of the container 204 is divided into two parts by the upright connecting wall 233. Thus, when the toner cartridge is mounted on the receiver portion of the developing device to discharge the toner in the container 204 through the discharge opening 220, the situation that in the truncated-conical lower part 210 the toner forms a so-called bridge between the curved walls 230*a* and 230*b* and obstructs a smooth flow is reliably prevented.

On the other side, when the shutter mechanism 106 shown in FIG. 5 is applied to the container 204 shown in FIGS. 11 to 15, the central area of the discharge opening 220 formed in the bottom end surface of the container 204 is situated not opposite the through-holes 104 formed in the main member 138 in the shutter mechanism 106, but opposite the central area of the shielding wall 156. Thus, the toner which is made to flow through the discharge opening 220 of the container 204 drops on the central area of the shielding wall 156. To prevent sufficiently reliably the toner, which dropped on the central area of the shielding wall 156, from staying there, the central area of the shielding wall 156 is preferably caused to extend upward away from the trough-holes 148 at an inclination angle β of at least 45 degrees to the horizontal. To make the shielding wall 156 an inclined surface which is inclined in its wide range at the inclination angle β of at least 45°, it is necessary that the height of the main member 138 in the shutter mechanism 106 be considerably large. When the inclination angle β is made 45 degrees or more only in its restricted central, however, it should be considered that the height of the main member 138 in the shutter mechanism 106 needs not be excessively large; thus, the production cost of the toner cartridge is not excessively increased, or the bulk of the toner cartridge is not excessively increased.

The present invention has been described in detail about some embodiments of a toner cartridge constructed in accordance with the invention with reference to the accompanying drawings. However, it should be understood that the invention is not restricted to such embodiments, and various changes and modifications may be made without departing from the spirit and scope of the invention.

What I claim is:

1. A toner cartridge comprising a container whose lower part is shaped like a truncated cone with an inside diameter tapering off downwardly and at a bottom end of which a discharge opening is formed; wherein a partition wall is disposed in the lower part of the container, and a cross sectional shape of the lower part defines a circle with the partition wall extending within that circle, and wherein the partition wall extends diametrically continuously on an inner peripheral surface of the lower part.

2. A toner cartridge comprising a container whose lower part is shaped like a truncated cone with an inside diameter tapering off downwardly and at a bottom end of which a discharge opening is formed; wherein a partition wall is disposed in the lower part of the container, and a cross sectional shape of the lower part defines a circle with the partition wall extending within that circle, and said toner cartridge further comprising a shutter mechanism mounted on the bottom end of the container, and wherein the shutter mechanism is constructed from a main member fixed at the bottom end of the container and a shutter member mounted on the main member so as to be movable between a closing position and an opening position, and when the shutter member is situated at the closing position, a through-hole formed in the main member and a passage opening formed in the shutter member are displaced from each other to close the discharge opening of the container, and when the shutter member is situated at the opening position, the through-hole and the passage opening are aligned with each other to open the discharge opening of the container via the through-hole and the passage opening, and wherein said partition wall is connected to the lower part of said container so that the partition wall moves together with said container upon movement of said container with respect to said shutter member.

3. A toner cartridge comprising a container whose lower part is shaped like a truncated cone with an inside diameter tapering off downwardly and at a bottom end of which a discharge opening is formed; wherein a partition wall is disposed in the lower part of the container, and a cross sectional shape of the lower part defines a circle with the partition wall extending within that circle, and wherein said partition wall has an edge which is free from connection with said lower part.

4. The toner cartridge of claim 3, comprising a plurality of partition walls which project inwardly radially from an inner peripheral surface of the lower part and which are disposed with spacing in a peripheral direction.

5. The toner cartridge of claim 4 wherein an inwardly projecting length of each of the plurality of partition walls is shorter than an inner, minimum radius of the lower part such that the partition walls do not extend to a central region of the lower part.

* * * * *